United States Patent [19]

Reece

[11] Patent Number: 4,490,057

[45] Date of Patent: Dec. 25, 1984

[54] PRINT WIRE SOLENOID

[75] Inventor: John W. Reece, Ithaca, N.Y.

[73] Assignee: NCR Corporation, Dayton, Ohio

[21] Appl. No.: 491,116

[22] Filed: May 3, 1983

[51] Int. Cl.[3] ..... B41J 3/12

[52] U.S. Cl. ..... 400/124; 400/167; 400/686; 101/93.05; 101/93.34; 335/257

[58] Field of Search ..... 400/124, 167, 157.2, 400/687, 688; 335/257, 271, 277, 248; 101/93.05, 93.29, 93.34, 93.48

[56] References Cited

U.S. PATENT DOCUMENTS

| | | | |
|---|---|---|---|
| 919,672 | 4/1909 | Anderson | 335/248 |
| 3,396,354 | 8/1968 | Fisher | 335/248 |
| 4,014,425 | 3/1977 | Gijzen et al. | 400/124 |
| 4,125,336 | 11/1978 | Chu | 101/93.05 X |
| 4,137,513 | 1/1979 | Reece et al. | 400/124 X |
| 4,272,748 | 6/1981 | Fugate et al. | 335/277 X |

*Primary Examiner*—William Pieprz
*Assistant Examiner*—Charles A. Pearson
*Attorney, Agent, or Firm*—J. T. Cavender; Wilbert Hawk, Jr.; Richard W. Lavin

[57] ABSTRACT

A matrix print wire solenoid used in a wire matrix printer and including an enclosure member releasably secured to one end of the solenoid by a spring member deformed by the outer surface of the enclosure member to pre-load the enclosure member and an energy absorbing member located adjacent the enclosure member. A plunger member to which one end of a print wire is affixed is located adjacent the energy absorbing member for engaging the member during the rebounding movement of the plunger member enabling the energy absorbing member to transmit impact forces to the enclosure and the spring members.

11 Claims, 8 Drawing Figures

PRINT WIRE SOLENOID

BACKGROUND OF THE INVENTION

1. Field of Invention

The present invention relates generally to impact printing devices for dot matrix printing in which a print wire is propelled against a printing medium by an associated plunger-type solenoid actuator and more particularly, the present invention relates to an improved matrix printer print wire solenoid constructed to provide quick assembly and disassembly of the component parts, thereby reducing the cost of its manufacture together with improving its reliability and performance.

2. Description of the Prior Art

Prior art print heads having plunger-type solenoids are generally constructed having a cap member mounted at one end of the solenoid which is crimped to hold the internal elements of the solenoid together. An example of this type of construction may be found in U.S. Pat. No. 4,272,748. Other plunger-type solenoids have utilized adjustable screw members for adjusting the load on the return spring member of the solenoid, after which the screw members are permanently secured to the solenoid. An example of this type of construction may be found in U.S. Pat. No. 3,994,382. Problems found with both types of construction include excessive cap member wear due to repeated impact of the returning plunger, uncontrolled variation in the length of movement of the plunger as a result of the crimping of the cap member, unreliable absorption of the impact of the rebounding plunger upon striking the cap member and an irrecoverable disassembly of the solenoid after crimping of the cap member has occurred.

SUMMARY OF THE INVENTION

The present invention comprises a plunger-type solenoid for driving the wire element of a dot matrix printer. The solenoid includes a housing member enclosing a coil assembly which in turn includes an elongated plunger slidably mounted within the coil assembly for reciprocal movement between a home and actuated position. A print wire affixed to one end of the plunger is moved to a printing position upon movement of the plunger to the actuated position. A compression spring mounted within the coil assembly normally urges the plunger to the home position where it engages an impact disc composed of an elastomeric material for absorbing the rebound movement of the plunger. The impact disc together with a cap member are held in a position adjacent the plunger by a retainer spring removably secured to the housing member. The retainer spring is held in a bowed configuration by the housing member, whereby preloading the cap member and the impact disc for help in absorbing the rebound movement of the plunger while retaining the cap member and the impact disc together with the coil assembly in correct registration within the housing member. The retainer spring is easily disengaged from the housing member allowing for the quick disassembly of the solenoid.

It is therefore an object of the present invention to provide an improved print wire solenoid constructed for easy assembly and disassembly.

It is another object of the present invention to provide an improved print wire solenoid constructed to absorb the plunger rebound in a more effective manner.

It is still another object of the present invention to provide a print wire solenoid including an improved solenoid plunger construction for increasing the operational life of the solenoid.

The foregoing and other objects, features and advantages of the invention will be apparent from the following detailed description of the preferred embodiment as illustrated by the accompanying drawing, wherein:

DESCRIPTION OF THE PREFERRED EMBODIMENT

Figure 1:
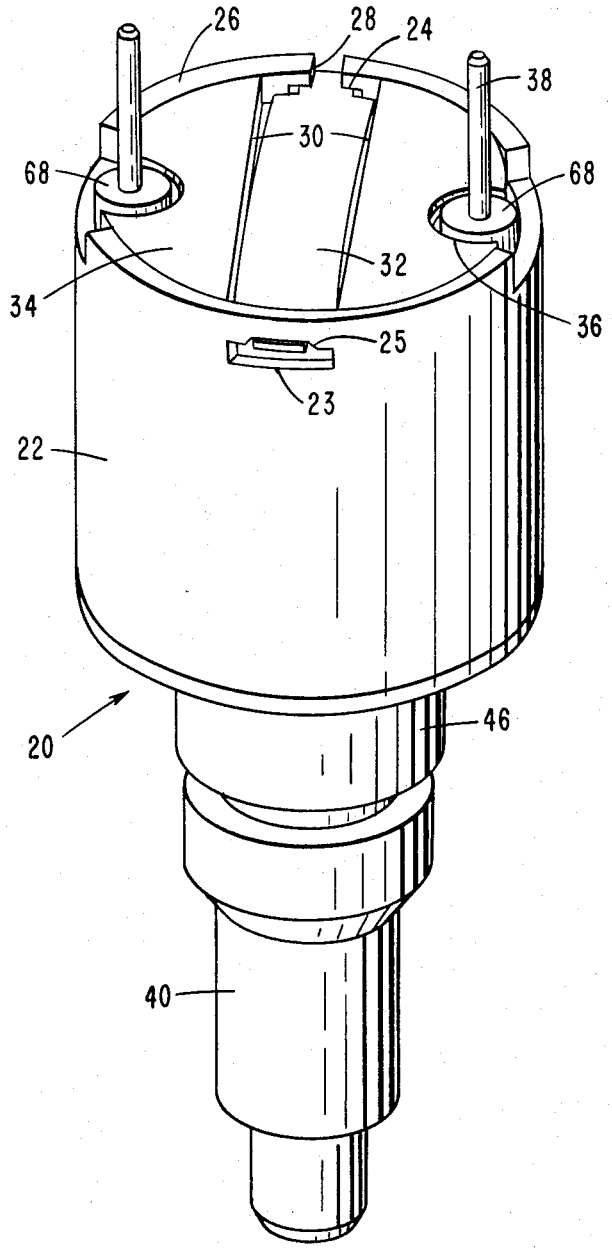
FIG. 1 is a perspective view of the print wire solenoid of the present invention showing the mounting of the retainer spring on the solenoid housing member.

Referring to FIG. 1, there is shown a perspective view of the print wire solenoid of the present invention generally indicated by the numeral 20 and whose construction includes a cylindrical housing member 22 having a pair of oppositely-located slots 23 and 24 positioned adjacent the peripheral edge 26 of the housing member 22. The slot 23 includes a notch portion 25 while the slot 24 has a notch opening 28 which extends through the edge 26 of member 22. A corner-notched retainer spring 32 is fed through slot 23 so as to engage slot 24 and the notch portion 25. The spring 32 is oriented in a bowed configuration (FIG. 3) due to the location of the slot 24 and the notch portion 25 with respect to an elevated curved central portion 31 (FIG. 3) of a groove 30 provided in the upper surface of a cap member 34. The cap member includes a pair of circular cut-out portions 36, each of which accommodates a metal pin 38 comprising an electrical terminal of the coil windings located within the housing member 22.

Figure 2:
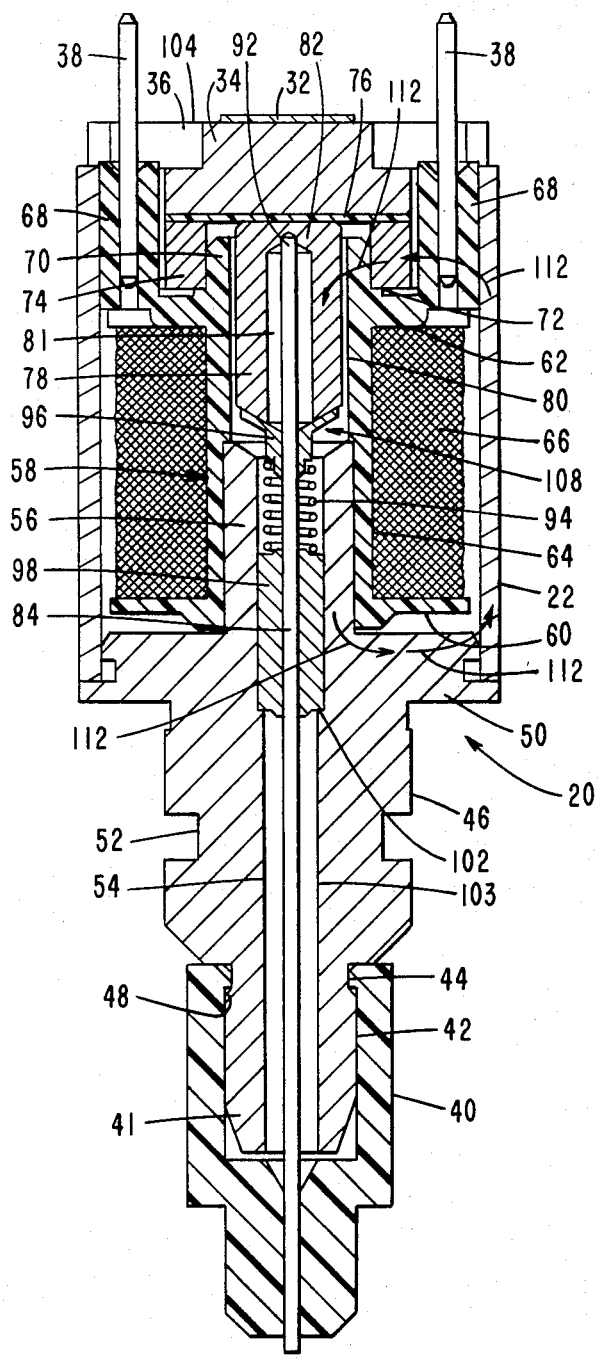
FIG. 2 is a longitudinal cross-sectional view of the preferred embodiment of the present invention taken along its central axis.

Referring now to FIG. 2, there is shown a longitudinal cross-sectional view of the solenoid 20 which also includes a cylindrical shape print wire guide member 40 which may be constructed of a hard plastic material such as acetal resin sold under the trademark "Delrin" manufactured by E. I. duPont de Nemouis and Co. of Wilmington, Del. The guide member 40 includes an opening 42 and an annular end flange portion 44 for use in mounting the guide member 40 to the forward end portion 41 of a solenoid core member 46 by snapping the flange portion 44 into an annular groove 48 of the core member 46.

The solenoid core member 46 is constructed of a suitable magnetic flux-carrying material such as steel and includes an annular flange portion 50 to which is staked or crimped one end of the housing member 22, an annular groove 52 forwardly of said portion 50 for use in mounting the solenoid member 20 in a correspondingly-shaped opening of a panel support or the like, and a stepped hole 54 extending through the core member along its longitudinal axis. The core member 46 further includes a cylindrical shaped rear end portion 56 through which the hole 54 extends and on which is seated a plastic bobbin generally indicated by the numeral 58 and which is comprised of a front wall portion 60 and an axially spaced rear wall portion 62 joined by a tubular center section 64 having a recessed edge 100 which seats against the top surface of the end portion 56. Wound on the center section 64 is typically four hundred and seventy five (475) turns of electric magnet wire comprising the coil windings 66. The rear wall portion 62 of the bobbin 58 includes a pair of rearwardly extending tubular portions 68 (FIGS. 1 and 2) through which the wire leads (not shown) from the coil windings 66 are passed so as to be contacted by the pressed-in metal terminal pins 38 for coupling the coil windings to the external drive electronics which supply the appropriate pulses to the coil windings 66 for energizing the solenoid 20.

Slidably positioned on an outer end portion 70 of the bobbin 58 and engaging a step portion 72 of the rear wall portion 62 of the bobbin is a circular pole member 74 (FIGS. 2 and 3) composed of a suitable magnetic flux-carrying material such as steel through which extends the path of magnetic flux generated by the energizing of the coil windings 66. The pole member 74 includes a pair of cut-out portions (not shown) similar to the cut-out portions 36 (FIG. 1) of the cap member 34 for accommodating the tubular portions 68. Covering the outer surface of the pole member 74 is a thin circular shaped impact disc 76 composed of an elastomeric material such as polyurethane which is engaged by the rear end of a plunger 78 slidably mounted within the core portion 80 of the bobbin member 58. The employment of polyurethane as the material for the disc 76 reduces the wear on the cap member 34 caused by the impact of the rebounding plunger 78. The plunger 78 is composed of a suitable magnetic material such as steel. Secured to the rear end portion 82 of the plunger 78 is a tungsten print wire 84. An interposer member 96, made of a plastic material such as nylon and positioned adjacent the forward end of the plunger 78, serves to limit plunger motion and provides a seat 83 (FIG. 3) for a return spring 94 yieldingly urging such plunger 78 in a rearward direction against the impact disc 76.

Figure 3:
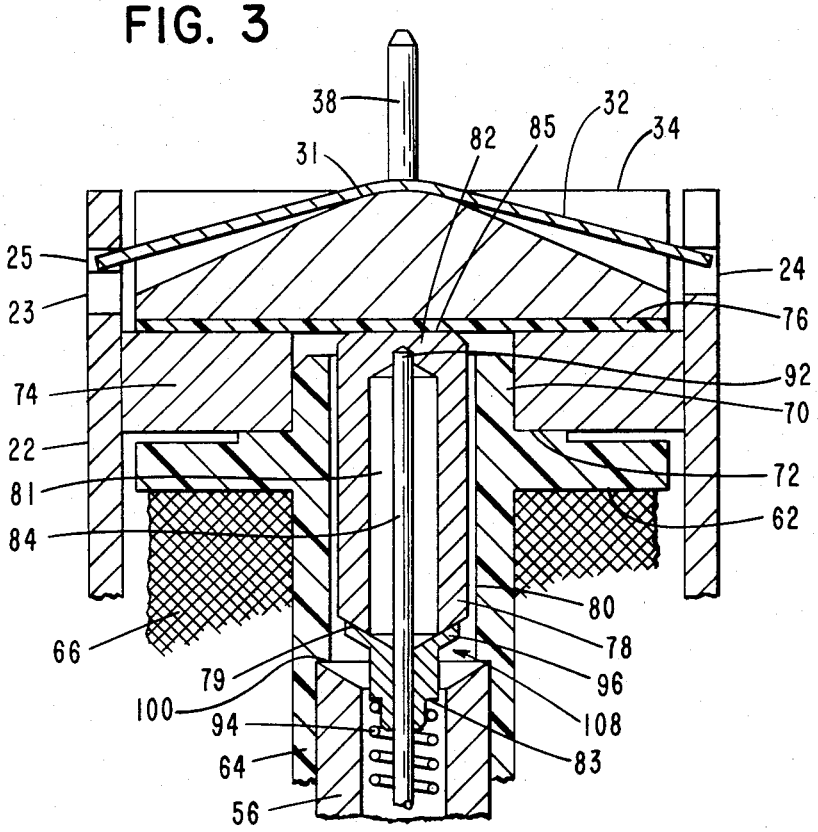
FIG. 3 is an enlarged partial longitudinal cross-sectional view of the solenoid taken along its central axis at 90° rotation from the view shown in FIG. 2.
Figure 4:
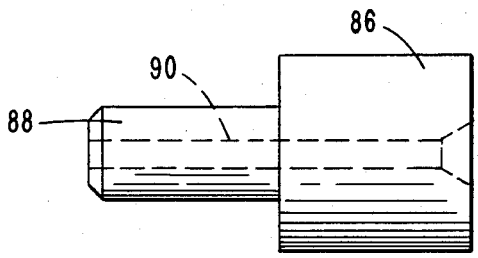
FIG. 4 is a side view of a cylindrical alignment tool used in affixing the print wire to the plunger.

An important feature of the present invention is the construction of the plunger 78 and the means provided for securing the print wire 84 to the plunger. The plunger 78 is of hollow construction for purposes of weight reduction and has the opening of its cavity 81 (FIGS. 2 and 3) oriented towards the front of the plunger so as to establish a pole face area distribution providing for maximum magnetic force. A small hole 92 is provided in the rear end portion 82 of the plunger 78 to receive the end of the print wire 84 prior to a brazing or welding operation. This hole is shown in FIGS. 2 and 3 as a blind hole, but may be a through hole. The print wire 84 is held centered in precise axial alignment with the plunger 78 during the brazing or welding operation, by piloting means such as provided by the alignment tool 86 shown in FIG. 4.

As illustrated, the alignment tool 86 is of cylindrical shape stainless steel and has a central hole 90 extending the length of the tool into which the print wire 84 is slidably inserted. A forward portion 88 of the tool 86 has a diameter which allows the tool to be slidably inserted into the cavity 81 of the plunger 78, following which the end of the wire 84 is inserted into the mating hole 92 in the rear end of the plunger. The wire is then secured to the plunger by the brazing or welding operation. By such process, the tendency for the print wire to be deflected off-center by previous assembly procedures involving plastic injection insert molding is eliminated. When the alignment tool 86 is withdrawn from the plunger the print wire 84 retains its cncentric alignment with the plunger 78.

If the mating hole 92 extends through the rear end portion 82 (FIG. 3) of the plunger 78, the rear surface 85 thereof is machined flat, if necessary, after the print wire 84 has been brazed to the plunger 78 to provide a relatively flat surface for abutting against the impact disc 76. With the rear surface 85 (FIG. 3) of the plunger 78 being solid metal and flat, it provides a maximum area for spreading the rebound impact load of the plunger over the impact disc 76 so as to minimize wear of the impact disc 76 and/or the cap member 34 and thus prevent such wear from being a limiting factor in the life of the solenoid.

The interposer member 96 (FIGS. 2 and 3) located within the core portion 80 of the bobbin member 58, made of the hard plastic material such as nylon, serves to limit the forward motion of the plunger 78 while providing a seat portion 83 for one end of the return spring 94. The other end of the spring 94 extends within the rear end of the hole 54 of core member 46 and, as shown in FIG. 2, engages a hard plastic core member 98 which is positioned within the hole 54 to slidably receive the print wire 84 therethrough and provide a forward seat for the spring 94. The core member 98 is seated against an annular shoulder 102 formed by the inner diameter of the hole 54. Such a construction simplifies the manufacture of the core member 46 by permitting a larger diameter forward end 103 of the hole 54 than would be the case if the forward spring seat were to be provided as an integral part of the core member 46.

Referring again to FIGS. 1, 2 and 3, there is shown mounted adjacent the outer surface of the impact disc 76 the cap member 34 which may be die-cast and composed of a suitably dense material such as a zinc alloy and which includes the groove 30 (FIG. 1) in its outer surface to accommodate the retainer spring 32. As previously described, this groove has a curved and elevated central portion 31 (FIG. 3). Due to the elevation of such portion 31 with respect to the location of the slot 24 and notch 25, the spring 32 will be bowed by the surface of such portion 31 when installed in the groove 30, thereby applying a force on the cap member 34 which in turn preloads the impact disc 76, the pole member 74, and the bobbin 58. This arrangement provides effective absorption of the rebound energy of the plunger 78 in its return impact against the combination of disc 76 and the spring loaded cap 34.

Figure 5A:
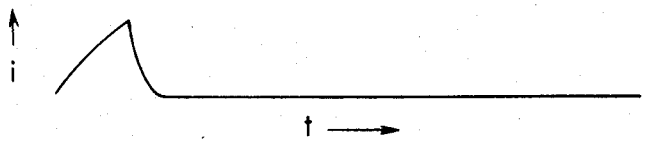
FIGS. 5A–5C inclusive show waveforms representing oscilloscope traces of the coil current and print wire motion during solenoid actuation.
Figure 5B:
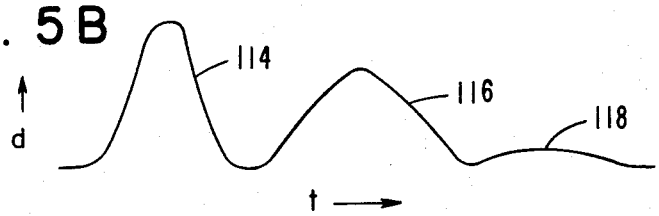
Figure 5C:
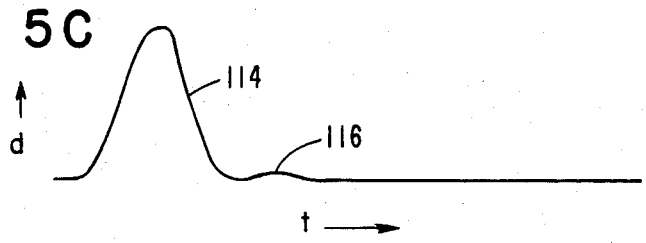
Figure 6:
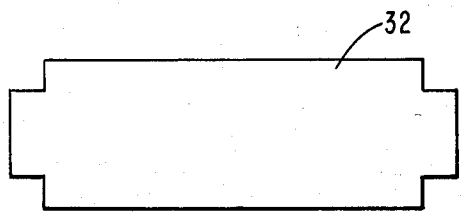
FIG. 6 is a plan view of the flat retainer spring used in mounting the cap member to the solenoid.

Instrumented testing has verified the desired near dead-beat character of this return impact phenomenon. The polyurethane disc 76 cushions the return impact of the plunger 78 and prevents wear between the plunger and the cap. The disc 76 also limits the elasticity of impact in order to control the subsequent division of momentum between the plunger and the cap. The role of the cap in this respect is to provide sufficient mass in the correct ratio to the mass of the plunger for further controlling the rebound phenomenon in conjunction with the impact disc. The resulting improved rebound control is illustrated by the waveforms of FIGS. 5A–5C inclusive representing oscilloscope traces of print wire motion. FIG. 5A shows the current (i) pulse in the case of a 325 microsecond duration (t) supplied from a 28 volt source. FIGS. 5B and 5C show print wire displacement (d) as measured by coupled LED/phototransistor instrumentation. Reading from left-to-right, the first loop 114 in FIG. 5B defines the print wire travel from rest position to impact on media and return. The second loop 116 and an attenuated third loop 118 indicate excessive plunger rebound action. This rebound action interferes with the cyclic operation of the print solenoid and has even been responsible for the occurrence of a secondary impact of the print wire with the media. In FIG. 5C, where the second loop 116 is greatly attenuated and the third loop 118 is entirely absent, there is illustrated a waveform taken for a unit which includes the spring loaded cap 34 and disc 76 arranged as described above, and showing the virtual dead-beat return impact characteristics which is the object of the present invention.

In assembling the solenoid 20, the housing member 22 is attached to the core member 46 by staking the housing member 22 to the flange 50 of the core member, after which the wire guide member 40 is snap-fitted to the forward end of the core member 46. The bobbin 58 is then slidably inserted into the housing member 22 and onto the rear end portion 56 of the core member 46. The pole member 74 is then mounted on the end portion 70 of the bobbin 58. With the print wire 84 concentrically aligned and affixed to the plunger 78, the interposer member 96 together with the compression spring 94 and the core member 98 are then assembled on the print wire 84 of the plunger 78, after which the plunger assembly is mounted within the core portion 80 of the bobbin 58.

After locating the plunger assembly within the bobbin 58, the impact disc 76 and the cap member 34 are positioned on the pole member 74 after which the retainer spring 32 is installed by feeding it through the slot 23 of the housing member 22 and directing the notched end thereof into the oppositely located slot 24. In its installed condition the deflected spring 32 is detented at both ends by its corner notches from moving out of engagement with the slot 24 at one end and with the notch 25 of slot 23 at the other end. Mounting of the retainer spring 32 in this manner will bow the spring, thereby preloading the cap member 34 and retaining the solenoid assembly in correct registration.

To disassemble the solenoid 20, the near end of the spring 32, as viewed in FIG. 1, is first depressed so as to take it out of detent with the notch portion 25, and the spring is then returned through slot 23 by pressing downwardly on the spring forward end and pushing on the far end of the spring 32 at notch 24. The notch opening 28 in the edge 26 of the housing member 22 facilitates both the installation and the removal process by providing access for a tool or fingernail or the like for pressing and pushing on the end of the spring 32. The remaining components of the solenoid 20 can then be removed in the reverse order of assembly. It will be seen from this construction that the assembly and disassembly of the solenoid 20 is extremely simple and can normally be accomplished by hand without the use of any tools.

In the operation of the solenoid 20, energizing pulses transmitted to the coil windings 66 results in the generation of a magnetic flux along the path indicated by the arrows 112 (FIG. 2) which includes the air gap 108 located between the interposer member 96 and the rear end portion 56 of the solenoid core member 46. This generation of magnetic flux results in the attraction of the plunger 78 to the end portion 56 of the core member 46. The air gap 108 defines the maximum extent of movement of the plunger 78 to an actuated position and may be in the order of 0.020 inch. The movement of the plunger drives the print wire 84 into engagement with the record medium and results in deflection of the compression spring 94. Upon the de-energizing of the coil windings 66, the spring 94 returns the plunger 78 to its home position against the impact disc 76 where the rebound energy is absorbed by such impact disc 76, the cap member 34 and the retainer spring 32.

While the invention has been shown and described with reference to the preferred embodiment thereof, it will be understood that persons skilled in the art may make modifications thereto without departing from the spirit and scope of the invention as defined by the claims appended hereto.

I claim:

1. A solenoid for moving a print wire to a printing position comprising:

a housing member having first and second ends;

a first magnetic flux conducting member enclosing said first end of said housing member and having an aperture extending therethrough;

a sleeve member mounted on a portion of said first conducting member having a cylindrical-shaped extension portion and and an axially oriented aperture extending therethrough;

a second magnetic flux conducting member mounted on said extension portion of said sleeve member;

a plunger member slidably positioned in said axially oriented aperture for movement between a home and an actuated position;

a print wire secured to said plunger member;

a coil member positioned on said sleeve member for providing, upon energizing of said coil member, a magnetic flux in a path through said housing member, said first and second conducting members and said plunger member to cause axial movement of said plunger member from said home to said actuated position for driving the print wire to a printing position;

means engaging said plunger member for maintaining said plunger member in said home position prior to energizing of said coil member and for returning said plunger member to said home position upon the deenergizing of said coil member;

an energy absorbing member positioned adjacent said second conducting member and adjacent said plunger member for absorbing the return movement of said plunger member to the home position;

an enclosure member mounted in said second end of said housing member and engaging said energy absorbing member;

and a spring member releasably secured to the second end of said housing member, said spring member engaging and biasing said enclosure member against said energy absorbing member, said spring member in turn biasing said energy absorbing member against said second flux conducting member and said plunger member, said spring member serving both as a means to retain said enclosure member, said energy absorbing member, said second flux conducting member and said sleeve member in said housing member and as a means to bias said energy absorbing member against said plunger member to absorb the energy of the plunger member as it returns to the home position from the actuated position.

2. The solenoid of claim 1 wherein said enclosure member has an arcuate surface engaging said spring member for deforming said spring member when the plunger member is in said home position whereby said spring member when mounted to said housing member is deformed to continuously engage the arcuate surface of said enclosure member.

3. The solenoid of claim 2 wherein said housing member comprises a hollow cylindrical shaped member having oppositely located apertures and said spring member engages said apertures for locating said spring member against the arcuate surface of said enclosure member enabling said arcuate surface to deform said spring member.

4. The solenoid of claim 3 wherein said spring member comprises an elongated planar spring member extending across the second end of said hollow cylindrical shaped member for engaging the oppositely located apertures and the arcuate surface of said enclosure member.

5. The solenoid of claim 4 in which said plunger member includes an axially extended opening which terminates in an end portion to which one end of the print wire is secured, said plunger member maintaining means includes a support member engaging said plunger member and a portion of the print wire for supporting said print wire in registry with the plunger member axially extending opening.

6. The solenoid of claim 5 in which said plunger member maintaining means further includes spring means engaging said support member for urging such support member into engagement with said plunger member, said spring means being actuated upon movement of the plunger member to said actuated position to return said plunger member to said home position.

7. In a matrix print head containing a solenoid driving a printing wire for printing a dot matrix of characters in response to the energization of said solenoid, said solenoid comprising:

a cylindrical shaped hollow housing member having first and second ends and oppositely located apertures positioned adjacent said second end;

a magnetic flux conducting enclosure member having an axially extending aperture, said enclosure member secured to said first end of said housing member;

a bobbin member positioned within said housing member and mounted on said enclosure member, said bobbin member having an axially aligned opening therethrough;

an apertured pole member mounted on one end of said bobbin member and located adjacent said second end of said housing member;

a plunger member slidably mounted in said bobbin member opening for movement between a home and an actuated position;

a print wire secured to said plunger member and extending through said bobbin member opening and the aperture in said enclosure member;

a coil member mounted on said bobbin member energizable in response to a magnetizing current for generating a magnetic flux in a path through said housing member, said enclosure and pole members and said plunger member to cause axial movement of said plunger member in a direction to the actuated position to drive the printing wire to the printing position;

a resilient disc member positioned adjacent said pole member and said plunger member for absorbing the return movement of said plunger member to the home position;

a cap member mounted on said disc member enclosing said second end of said housing member;

and a spring member releasably secured to the second end of said housing member, said spring member engaging and biasing said cap member against said resilient disc member, said spring member in turn biasing said resilient disc member against said apertured pole member and said plunger member, said spring member serving both as a means to retain said cap member, said resilient disc member, said apertured pole member and said bobbin member in said housing member and as a means to bias said resilient disc member against said plunger member to absorb the energy of the plunger member as it returns to the home position from the actuated position.

8. The solenoid of claim 7 in which said cap member has an arcuate surface engaging said spring member whereby said spring member is deformed upon engagement with the arcuate surface of the cap member when the cap member is secured to said housing member for pre-loading said cap member and said disc member.

9. The solenoid of claim 8 in which said spring member comprises an elongated planar spring member engaging said apertures in the opposite sides of said housing member for releasably holding the cap member within said housing member.

10. The solenoid of claim 9 in which said plunger member includes an axially aligned opening extending through a portion of the plunger member and an end portion positioned adjacent the disc member to which one end of the printing wire is secured, said solenoid further includes a support member engaging the aligned opening of the plunger member and a portion of the printing wire for supporting said printing wire in registry with the aligned opening.

11. The solenoid of claim 10 which further includes spring means engaging said support member for urging such support member into engagement with said plunger member, said spring means being actuated upon movement of the plunger member to said actuated position to return said plunger member to said home position.

* * * * *